US008648777B2

(12) United States Patent
Yamashita et al.

(10) Patent No.: US 8,648,777 B2
(45) **Date of Patent: *Feb. 11, 2014**

(54) DISPLAY APPARATUS, METHOD OF DRIVING DISPLAY APPARATUS, AND ELECTRONIC APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/568,830

(22) Filed: Aug. 7, 2012

(65) Prior Publication Data

US 2013/0057535 A1 Mar. 7, 2013

Related U.S. Application Data

(63) Continuation of application No. 12/314,314, filed on Dec. 8, 2008, now Pat. No. 8,237,632.

(30) Foreign Application Priority Data

Jan. 15, 2008 (JP) ..... 2008-005257

(51) Int. Cl.
*G09G 3/30* (2006.01)

(52) U.S. Cl.
USPC ..... 345/76; 315/169.1

(58) Field of Classification Search
USPC ..... 345/76–83; 315/169.3, 169.1; 313/463, 313/504
See application file for complete search history.

(56) References Cited

U.S. PATENT DOCUMENTS

| | | | |
|---|---|---|---|
| 7,057,588 | B2 | 6/2006 | Asano et al. |
| 7,102,202 | B2 | 9/2006 | Kobayashi et al. |
| 7,109,952 | B2 | 9/2006 | Kwon |
| 2004/0189560 | A1 | 9/2004 | Murakata et al. |
| 2005/0206590 | A1 | 9/2005 | Sasaki et al. |
| 2005/0269959 | A1 | 12/2005 | Uchino et al. |
| 2006/0170628 | A1 | 8/2006 | Yamashita et al. |
| 2007/0247399 | A1 | 10/2007 | Yamashita et al. |
| 2007/0257868 | A1 | 11/2007 | Kasai |
| 2007/0268210 | A1 | 11/2007 | Uchino et al. |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2006-215213 | | 8/2006 |
| JP | 2007-310311 | A | 11/2007 |

OTHER PUBLICATIONS

Japanese Office Action issued Dec. 22, 2010 for corresponding Japanese Application No. 2008-005257.

*Primary Examiner* — Hong Zhou
(74) *Attorney, Agent, or Firm* — Rader, Fishman & Grauer PLLC

(57) ABSTRACT

Disclosed herein is a display apparatus including a pixel array and a driver, the pixel array including rows of scanning lines, rows of feeding lines, columns of signal lines, and a matrix of pixels disposed at the crossings of the scanning lines and the signal lines, the driver including a write scanner for supplying a control signal successively to the scanning lines, a power supply scanner for switching each of the feeding lines between a high potential, a low potential, and an intermediate potential between the high potential and the low potential, and a signal selector for supplying a video signal, which alternately switches between a signal potential and a reference potential, to each of the signal lines.

5 Claims, 12 Drawing Sheets

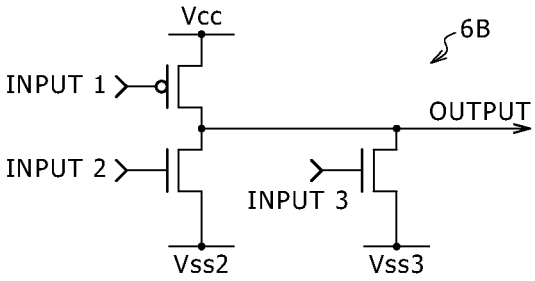
FIG. 8
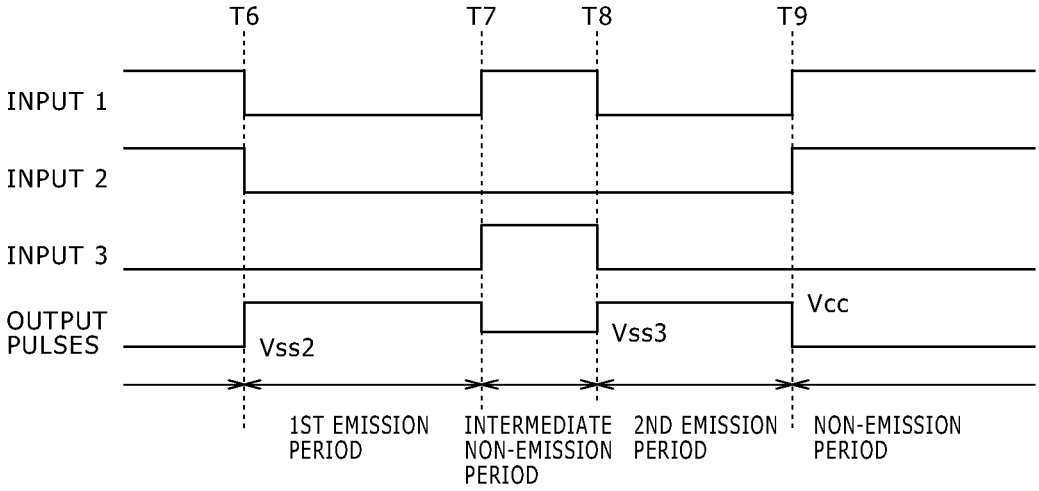

DISPLAY APPARATUS, METHOD OF DRIVING DISPLAY APPARATUS, AND ELECTRONIC APPARATUS

CROSS REFERENCES TO RELATED APPLICATIONS

The present application is a Continuation of U.S. application Ser. No. 12/314,314, filed Dec. 8, 2008, which claims priority to Japanese Patent Application JP 2008-005257 filed in the Japan Patent Office on Jan. 15, 2008, the entire contents of which being incorporated herein by reference.

BACKGROUND OF THE INVENTION

1. Field of the Invention

The present invention relates to an active matrix display apparatus having light-emitting elements as pixels, a method of driving such an active matrix display apparatus, and an electronic apparatus incorporating such an active matrix display apparatus.

2. Description of the Related Art

Display apparatus, e.g., liquid crystal display apparatus, have a number of liquid crystal pixels arranged in a matrix. The intensity of incident light that is transmitted through or reflected by each of the pixels is controlled depending on image information to be displayed for thereby display an image based on the image information. The above principle of operation also applies to organic EL (electroluminescence) display apparatus which having organic EL elements as pixels. Organic EL elements are self-emission elements unlike the liquid crystal pixels. Therefore, the organic EL display apparatus provides better image visibility than the liquid crystal display apparatus, need no backlight, and have a high response speed. In addition, the organic EL display apparatus are widely different from the voltage-controlled liquid crystal display apparatus in that they are current-controlled by controlling the luminance levels (gradations) of the light-emitting elements with currents flowing therethrough.

As with the liquid crystal display apparatus, the organic EL display apparatus are classified into the simple matrix type and the active matrix type. Although the former type is simple in structure, it makes it difficult to construct large-size, high-definition display apparatus. At present, therefore, efforts are mainly directed to the development of active matrix organic EL display apparatus. According to the active matrix type, the currents flowing through the light-emitting elements in respective pixel circuits are controlled by active elements, generally thin-film transistors (TFTs), disposed in the respective pixel circuits. Active matrix organic EL display apparatus are disclosed in the following patent documents, Japanese Patent Laid-Open Nos. 2003-255856, 2003-271095, 2004-133240, 2004-029791, 2004-093682, and 2006-215213.

SUMMARY OF THE INVENTION

Heretofore, a pixel circuit is disposed at the crossing of a scanning line extending as a row for supplying a control signal and a signal line extending as a column for supplying a video signal, and includes at least a sampling transistor, a retentive capacitor, a driving transistor, and a light-emitting element. The sampling transistor is rendered conductive in response to the control signal supplied from the scanning line, sampling the video signal supplied from the signal line. The retentive capacitor retains an input voltage depending on the signal potential of the sampled video signal. The driving transistor supplies, as a drive current, an output current in a predetermined light emission period depending on the input voltage retained by the retentive capacitor. Generally, the output current depends on the carrier mobility and threshold voltage of a channel region of the driving transistor. The light-emitting element emits light at a luminance level depending on the video signal based on the output current supplied from the driving transistor.

When the driving transistor is supplied at its gate with the input voltage retained by the retentive capacitor, the driving transistor passes the output current between its source and drain, thereby energizing the light-emitting element. Generally, the emission luminance of the light-emitting element is proportional to the amount of current flowing therethrough. The amount of output current supplied from the driving transistor is controlled by the gate voltage, i.e., the input voltage written in the retentive capacitor. The pixel circuit controls the amount of current supplied to the light-emitting element by changing the input voltage applied to the driving transistor depending on the input video signal.

The operating characteristic of the driving transistor is expressed by the following equation:

$$Ids=(1/2)\mu(W/L)Cox(Vgs-Vth)^2$$

where Ids represents the drain current flowing between the source and the drain, i.e., the output current supplied to the light-emitting element, Vgs the gate voltage applied to the gate with respect to the source, i.e., the input voltage, Vth the threshold voltage of the driving transistor, μ the mobility of a thin semiconductor film serving as the channel of the driving transistor, W the channel width, L the channel length, and Cox the gate capacitance. As can be seen from the above equation, when the thin-film transistor operates in the saturated region, if the gate voltage Vgs exceeds the threshold voltage Vth, then the thin-film transistor is turned on, causing the drain current Ids to flow. In principle, if the gate voltage Vgs is constant, then the drain current Ids is supplied at a constant rate to the light-emitting element, as indicated by the above equation.

Display apparatus of the related art display a moving image by updating an image in every field. In one field, scanning lines are scanned once in a line-sequential fashion to write and display an image. It has heretofore been customary to divide each field into an emission period and a non-emission period and to energize the pixels only in the emission period for the purpose of improving moving image characteristics to display moving images similar to those displayed on CRTs. The screen luminance can be adjusted by changing the ratio (duty ratio) between the emission period and the non-emission period in each field. In each of the pixel circuits of the display apparatus of the related art, a reverse bias voltage is applied to the light-emitting element in the non-emission period. However, when a reverse bias voltage is applied to a two-terminal or diode light-emitting element, the light-emitting element tends to be deteriorated.

It has been proposed in the art to alternately repeat the emission period and the non-emission period in each field in order to reduce flickering on the display screen. According to the proposal, a non-emission period is inserted between two adjacent emission periods. However, the display apparatus of the related art are disadvantageous in that because of the structure of the pixel circuit, the sampling transistor causes a current leak in the non-emission period, changing the level of the video signal written in the retentive capacitor. As a result, images displayed on the display screen suffer shading and crosstalk.

It is an aim of the embodiments of the present invention to provide a display apparatus which prevents light-emitting elements from being reversely biased in non-emission periods.

Another aim of the embodiments of the present invention is to provide a display apparatus which prevents sampling transistors from causing a current leak in non-emission periods.

To achieve the above aims, there is provided in accordance with the embodiments of the present invention a display apparatus including a pixel array and a driver, the pixel array including rows of scanning lines, rows of feeding lines, columns of signal lines, and a matrix of pixels disposed at the crossings of the scanning lines and the signal lines, each of the pixels including at least a sampling transistor, a driving transistor, a light-emitting element, and a retentive capacitor, the sampling transistor having a control terminal connected to one of the scanning lines and a pair of current terminals connected between one of the signal lines and a control terminal of the driving transistor, the driving transistor having a pair of current terminals, one of which is connected to the light-emitting element and the other of which is connected to one of the feeding lines, the retentive capacitor being connected between the control terminal of the driving transistor and one of the current terminals of the driving transistor, the driver including a write scanner for supplying a control signal successively to the scanning lines, a power supply scanner for switching each of the feeding lines between a high potential, a low potential, and an intermediate potential between the high potential and the low potential, and a signal selector for supplying a video signal, which alternately switches between a signal potential and a reference potential, to each of the signal lines, wherein the driver performs a threshold voltage correcting process for supplying the control signal and the video signal and switching the feeding lines between the high, low, and intermediate potentials according to a predetermined sequence to energize the pixels for thereby correcting variations in a threshold voltage of the driving transistor, a writing process for writing the signal potential in the retentive capacitor, an energizing process for energizing the light-emitting element into an emission state depending on the written signal potential, and a de-energizing process for de-energizing the light-emitting element into a non-mission state, and wherein immediately before the pixels perform the threshold voltage correcting process, the power supply scanner switches the feeding lines to the low potential in preparation for the threshold voltage correcting process, and wherein during the emission period in which the pixels are energized, the power supply scanner switches the feeding lines to the high potential to supply a current for emission, and during the non-emission period in which the pixels are de-energized, the power supply scanner switches the feeding lines to the intermediate potential to stop supplying the current.

Preferably, the light-emitting element has a cathode connected to a predetermined cathode potential and an anode connected to the one of the current terminals of the driving transistor. The power supply scanner sets the intermediate potential to be supplied to the feeding line during the non-emission period such that the difference between the anode potential and the cathode potential falls within a threshold voltage of the light-emitting element. The pixel alternately repeats the emission period and the non-emission period in each field period. The power supply scanner sets the intermediate potential to be supplied to the feeding line during the non-emission period for suppressing fluctuations of the signal potential written in the retentive capacitor in a non-emission period between two adjacent emission periods. When the signal potential is written into the retentive capacitor, a current flowing between the current terminals of the driving transistor is negatively fed back to the retentive capacitor to correct the signal potential for the mobility of the driving transistor.

According to the embodiments of the present invention, immediately before the pixels perform the threshold voltage correcting process, the power supply scanner switches the feeding lines to the low potential in preparation for the threshold voltage correcting process. During the emission period in which the pixels are energized, the power supply scanner switches the feeding lines to the high potential to supply a current for emission, and during the non-emission period in which the pixels are de-energized, the power supply scanner switches the feeding lines to the intermediate potential to stop supplying the current. In other words, during the non-emission period, the power supply scanner supplies the intermediate potential between the high potential and the low potential to the feeding line to prevent the light-emitting element from being reversely biased in the non-emission period for thereby preventing the light-emitting element from being unduly degraded. According to the related art, the feeding line switches between two levels, i.e., the high potential and the low potential. Although the low potential is desired in preparation for the threshold voltage correcting process, the low potential supplied to the feeding line during the non-emission period tends to reverse bias the light-emitting element. According to the embodiments of the present invention, however, the feeding line switches between three levels, i.e., the high potential, the intermediate potential, and the low potential, and during the non-emission period, the power supply scanner applies the intermediate potential, rather than the low potential, to the feeding line to prevent the light-emitting element from being reversely biased. The intermediate potential applied to the feeding line is also effective to prevent the sampling transistor from causing a current leak thereby to prevent the signal potential written in the retentive capacitor from fluctuating in the non-emission period. Consequently, images displayed on the display screen of the display apparatus are of improved quality free of shading and crosstalk. According to the embodiments of the present invention, as described above, the feeding line switches between the three levels, i.e., the high potential, the intermediate potential, and the low potential, to prevent the light-emitting element from being reversely biased and also to prevent the sampling transistor from causing a current leak during the non-emission period.

The above and other aims, features, and advantages of the embodiments of the present invention will become apparent from the following description when taken in conjunction with the accompanying drawings which illustrate preferred embodiments of the present invention by way of example.

BRIEF DESCRIPTION OF THE DRAWINGS

FIG. 8 is a circuit diagram of a power supply scanner according to another embodiment;

DETAILED DESCRIPTION OF THE PREFERRED EMBODIMENTS

Figure 1:
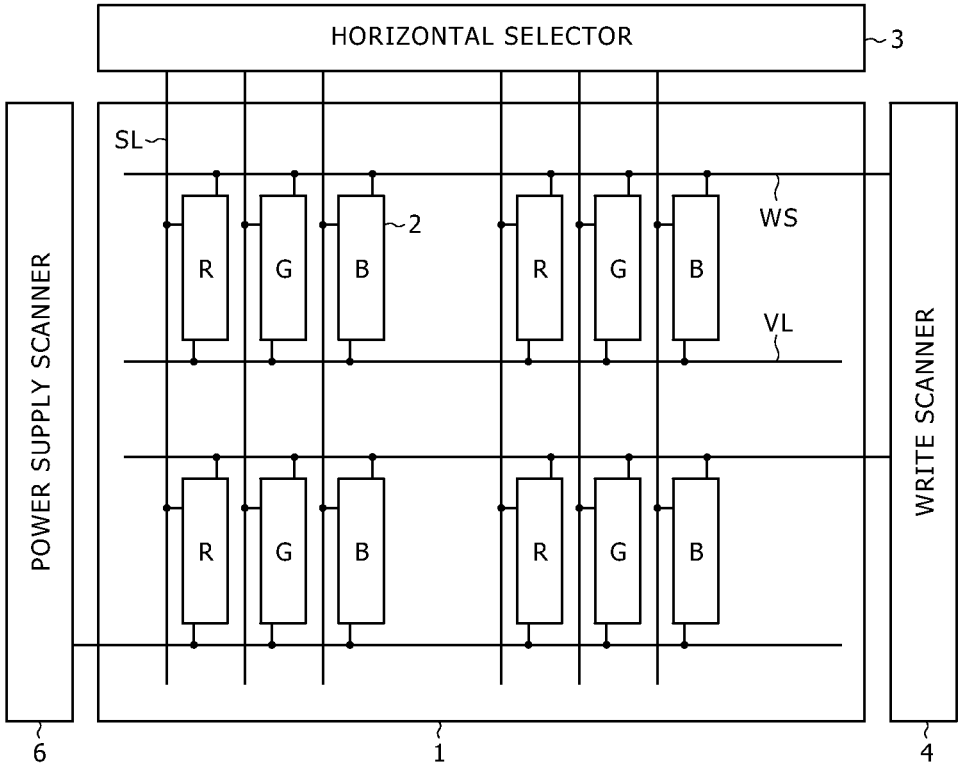
FIG. 1 is a block diagram of a display apparatus according to the embodiments of the present invention.

A display apparatus according to embodiments of the present invention will be described in detail below with reference to the drawings. FIG. 1 shows in block form the display apparatus according to an embodiment of the present invention. As shown in FIG. 1, the display apparatus includes a pixel array 1 and a driver for driving the pixel array 1. The pixel array 1 includes rows of scanning lines WS, columns of signal lines SL, a matrix of pixels 2 disposed at crossings of the scanning lines WS and the signal lines SL, and feeding lines (power supply lines) VL associated with respective rows of the pixels 2. Either one of three primaries R (red), G (green), B (blue) is assigned to each of the pixels 2 for the display apparatus to display color images. However, the display apparatus according to the embodiment of the present invention may be a monochromatic display apparatus. The driver includes a write scanner 4 supplying a control signal successively to the scanning lines WL, a power supply scanner 6 for switching each of the feeding lines VL between a high potential, a low potential, and an intermediate potential between the high and low potentials, and a signal selector (horizontal selector) 3 for supplying a video signal, which alternately switches between a signal potential and a reference potential, to the signal lines SL. The driver supplies the control signal and the video signal and switches the feeding lines VL between the high, low, and intermediate potentials according to a predetermined sequence to energize the pixels 2.

Figure 2:
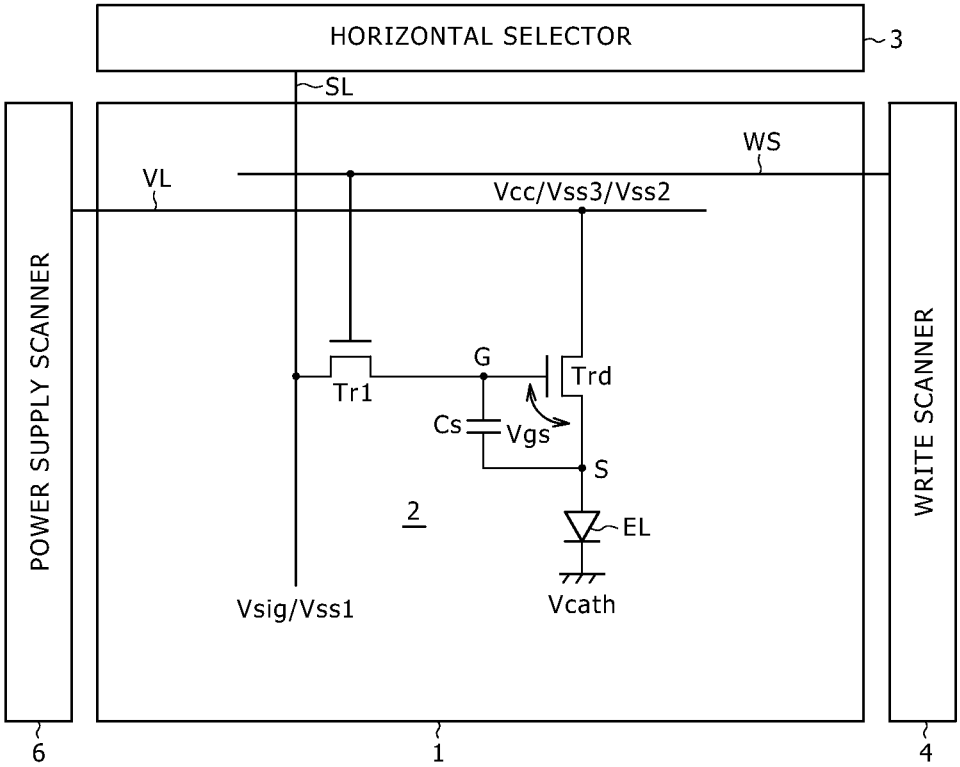
FIG. 2 is a circuit diagram of a pixel circuit included in the display apparatus according to the embodiments of the present invention.

FIG. 2 is a circuit diagram showing specific structural details and interconnections of each pixel 2 included in the display apparatus shown in FIG. 1. As shown in FIG. 2, the pixel 2 includes a light-emitting element EL typically having an organic EL device, a sampling transistor Tr1, a driving transistor Trd, and a retentive capacitor Cs. The sampling transistor Tr1 has a control terminal (gate) connected to the corresponding scanning line WS and a pair of current terminals (source and drain), one of which is connected to the corresponding signal line SL and the other to the control terminal (gate G) of the driving transistor Trd. The driving transistor Trd has a pair of current terminals (source S and drain), one of which is connected to the light-emitting element EL and the other to the corresponding feeding line VL. According to the present embodiment, the driving transistor Trd is of the N-channel type with the drain being connected to the feeding line VL and the source S being connected as an output node to the anode of the light-emitting element EL. The cathode of the light-emitting element EL is connected to a given cathode potential Vcath. The retentive capacitor Cs is connected between the source S which is one of the current terminals of the driving transistor Trd and the gate G which is the control terminal of the driving transistor Trd. The driver supplies control signals to the scanning lines WS, supplies video signals to the signal lines SL, and switches the feeding lines VL between a high potential Vcc, a low potential Vss2, and an intermediate potential Vss3 according to a predetermined sequence to energize the pixels 2, for thereby performing a threshold voltage correcting process for correcting variations in the threshold voltage Vth of the driving transistor Trd, a writing process for writing a signal potential Vsig in the retentive capacitor Cs, an energizing process for energizing the light-emitting element EL into an emission state depending on the written signal potential Vsig, and a de-energizing process for de-energizing the light-emitting element EL into a non-mission state.

According to the present embodiment, immediately before the pixels 2 perform a threshold voltage correcting process, the power supply scanner 6 of the driver switches the feeding lines VL to the low potential Vss2 in preparation for the threshold voltage correcting process. During an emission period in which the pixels 2 are energized, the power supply scanner 6 switches the feeding lines VL to the high potential Vcc to supply a current for emission, and during a non-emission period in which the pixels 2 are de-energized, the power supply scanner 6 switches the feeding lines VL to the intermediate potential Vss3 to stop supplying the current.

In the present embodiment, the light-emitting element EL is of the diode type or the two-terminal type, and has a cathode connected to the cathode potential Vcath and an anode connected to one of the current terminals, i.e., the source S, of the driving transistor Trd. The power supply scanner 6 sets the intermediate potential Vss3 to be supplied to the feeding line VL during the non-emission period such that the difference between the anode potential and the cathode potential Vcath falls within a threshold voltage Vthe1 of the light-emitting element EL. Since the anode-to-cathode voltage of the light-emitting element EL does not exceed the threshold voltage Vthe1, the light-emitting element EL is cut off and de-energized. Since the intermediate potential Vss3 is set such that the anode potential of the light-emitting element EL is higher than the cathode potential Vcath, the light-emitting element EL will not be in a reversely biased state during the non-emission period. Accordingly, the light-emitting element EL is prevented from being unduly degraded. The reversely biased state refers to a state in which the anode potential of the light-emitting element is lower than the cathode potential thereof, and a reverse voltage is applied to the light-emitting element.

According to a mode of the present embodiment, each of the pixels 2 alternately repeats the emission period and the non-emission period in each field in order to reduce flickering on the display screen. At this time, the power supply scanner 6 sets the intermediate potential Vss3 to be supplied to the feeding line VL during the non-emission period for suppressing fluctuations of the signal potential Vsig written in the retentive capacitor Cs in a non-emission period between two adjacent emission periods. When the signal potential Vsig is written into the retentive capacitor Cs, the current flowing between the current terminals, i.e., the source and the drain, of the driving transistor Trd is negatively fed back to the retentive capacitor Cs to correct the signal potential Vsig for the mobility μ of the driving transistor Trd.

Figure 3:
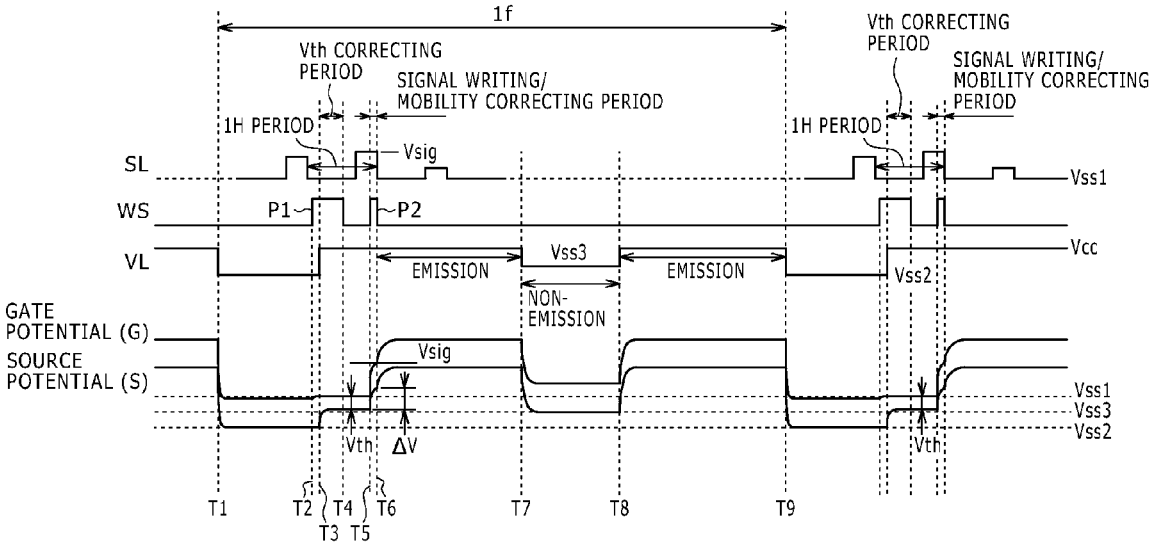
FIG. 3 is a timing chart illustrative of operation of the display apparatus according to the embodiments of the present invention.

FIG. 3 is a timing chart illustrative of operation of the pixel circuit 2 according to the present embodiment shown in FIG. 2. The timing chart shows how the potential of the scanning line WS, the potential of the feeding line VL, and the potential of the signal line SL change along a common time axis. The timing chart also shows how the potentials of the gate G and the source S of the driving transistor Trd change.

Control signal pulses for turning on the sampling transistor Tr1 are applied to the scanning line WS. The control signal pulses are applied to the scanning line WS in each field period (1*f*) in timed relation to the line-sequential scanning of the pixel array. The control signal pulses include two pulses, i.e., first and second pulses P1 and P2, in each horizontal scanning period (1H). The feeding line VL switches between the high potential Vcc, the low potential Vss2, and the intermediate potential Vss3 in each field period (1*f*). The signal line SL is supplied with a video signal that switches between the signal potential Vsig and the reference potential Vss1 in each horizontal scanning period (1H).

As shown in FIG. 3, the pixel alternately repeats the emission period and the non-emission period in each field period (1*f*) in order to reduce flickering on the display screen. Specifically, the pixel enters a first non-emission period of the present field at timing T1 from an emission period of the preceding field. Then, the pixel enters a first emission period, then a second non-emission period, and then a second emission period. According to the present embodiment, the emission period and the non-emission period are repeated each twice. However, the embodiments of the present invention are not limited to such a repetitive pattern. When the second emission period of the present field is finished, the pixel enters a first non-emission period of the next field at timing T9. According to the present embodiment, a preparing process, a threshold voltage correcting process, a signal writing process, and a mobility correcting process are performed in the first non-emission period of the present field.

In the second emission period of the preceding field, the feeding line VL is at the high potential Vcc, and the driving transistor Trd supplies the drain current Ids to the light-emitting element EL. The drain current Ids flows from the feeding line VL at the high potential Vcc through the driving transistor Trd into the light-emitting element EL, from which the drain current Ids flows into the cathode line.

At timing T1 when the pixel enters the first non-emission period of the present field, the feeding line VL switches from the high potential Vcc to the low potential Vss2. The feeding line VL is discharged to the low potential Vss2, lowering the potential of the source S of the driving transistor Trd to the low potential Vss2. The anode potential of the light-emitting element EL, i.e., the source potential of the driving transistor Trd, is now reversely biased, whereupon the drain current Ids stops flowing and the light-emitting element EL is de-energized. As the potential of the source S of the driving transistor Trd is lowered, the potential of the gate G thereof is also lowered.

At timing T2, the scanning line WS switches from the low level to the high level with the first pulse P1, rendering the sampling transistor Tr1 conductive. At this time, the signal line SL is at the reference potential Vss1. The potential of the gate G of the driving transistor Trd is now equalized to the reference potential Vss1 of the signal line SL through the sampling transistor Tr1 which has been rendered conductive. At this time, the potential of the source S of the driving transistor Trd is the low potential Vss2 which is sufficiently lower than the reference potential Vss1. In this manner, the voltage Vgs between the gate G and the source S of the driving transistor Trd is initialized to a level higher than the threshold voltage Vth of the driving transistor Trd. A period T1 to T3 from timing T1 to timing T3 serves as a preparatory period for setting voltage Vgs between the gate G and the source S of the driving transistor Trd to a level higher than the threshold voltage Vth in advance.

At timing T3, the feeding line VL switches from the low potential Vss2 to the high potential Vcc, and the potential of the source S of the driving transistor Trd starts rising. When the voltage Vgs between the gate G and the source S of the driving transistor Trd reaches the threshold voltage Vth, the current is cut off. In this manner, a voltage corresponding to the threshold voltage Vth of the driving transistor Trd is written in the retentive capacitor Cs. This process is referred to as the threshold voltage correcting process. At this time, the cathode potential Vcath is set to cut off the light-emitting element EL such that the current flows only into the retentive capacitor Cs, but not into the light-emitting element EL.

At timing T4, the scanning line WS switches from the high level back to the low level. Stated otherwise, the first pulse P1 applied to the scanning line WS is canceled, turning off the sampling transistor Tr1. As can be understood from the above description, the first pulse P1 is applied to the gate of the sampling transistor Tr1 to perform the threshold voltage correcting process.

Thereafter, the signal line SL switches from the reference potential Vss1 to the signal potential Vsig. Then, at timing T5, the scanning line WS switches again from the low level to the high level with the second pulse P2 that is applied to the gate of the sampling transistor Tr1. The sampling transistor Tr1 is turned on again, sampling the signal potential Vsig from the signal line SL. The potential of the gate G of the driving transistor Trd is now equalized to the signal potential Vsig. Since the light-emitting element EL is initially in the cut-off state, i.e., a high-impedance state, the current flowing between the drain and the source of the driving transistor Trd flows into the retentive capacitor Cs and an equivalent capacitor of the light-emitting element EL, starting to charge them. Until the sampling transistor Tr1 is turned off at timing T6, the potential of the source S of the driving transistor Trd increases by a voltage ΔV. In this manner, the signal potential Vsig of the video signal is written into the retentive capacitor Cs in addition to the threshold voltage Vth, and the voltage ΔV for mobility correction is subtracted from the voltage retained by the retentive capacitor Cs. Thus, a period T5 to T6 from timing T5 to timing T6 serves as a signal writing period and a mobility correcting period. Stated otherwise, when the second pulse P2 is applied to the scanning line WS, the signal writing process and the mobility correcting process are performed. The signal writing period and the mobility correcting period T5 to T6 is equal to the pulse duration of the second pulse P2. In other words, the pulse duration of the second pulse P2 defines the mobility correcting period.

In the signal writing period T5 to T6, the signal potential Vsig is written and the corrective voltage ΔV is adjusted at the same time. As the signal potential Vsig is higher, the current Ids supplied by the driving transistor Trd is greater, and so is the absolute value of the corrective voltage ΔV. Accordingly, the mobility is corrected depending on the emission luminance level. If the signal potential Vsig is constant, then the absolute value of the corrective voltage ΔV is greater as the mobility μ of the driving transistor Trd is higher. Stated otherwise, as the mobility μ of the driving transistor Trd is higher, the negative feedback quantity ΔV for the retentive capacitor Cs is greater for thereby removing variations of the mobility μ that are specific to the respective pixels.

At timing T6, the scanning line WS changes to the low level, turning off the sampling transistor Tr1. The gate G of the driving transistor Trd is now disconnected from the signal line SL. At this time, the drain current Ids starts to flow through the light-emitting element EL. The anode potential of the light-emitting element EL rises depending on the drive current Ids. The rise of the anode potential of the light-emitting element EL is equivalent to the rise of the potential of the source S of the driving transistor Trd. When the potential of the source S of the driving transistor Trd rises, the potential of the gate G of the driving transistor Trd also rises due to a bootstrap action of the retentive capacitor Cs. The amount by which the potential of the gate G of the driving transistor Trd rises is equal to the amount by which the potential of the source S of the driving transistor Trd rises. Therefore, the gate voltage Vgs between the gate G and the source S of the driving transistor Trd during the emission period is kept constant. The value of the gate voltage Vgs is represented by the signal potential Vsig that is corrected for the threshold voltage Vth and the mobility μ. The driving transistor Trd operates in the saturated region. In other words, the driving transistor Trd outputs the drive current Ids depending on the gate voltage Vgs between the gate G and the source S of the driving transistor Trd.

At timing T7, the first emission period is finished, and the second non-emission period is started. The second non-emission period continues from timing T7 to timing T8. At timing T7, the feeding line VL switches from the high potential Vcc to the intermediate potential Vss3. The source potential of the driving transistor Trd, i.e., the anode potential of the light-emitting element EL, drops substantially to the intermediate potential Vss3, cutting off the light-emitting element EL. The intermediate potential Vss3 is higher than the lower potential Vss2 and lower than the high potential Vcc. The intermediate potential Vss3 is set to satisfy the condition: Vcath<Vss3<Vcath+Vthe1. As described above, the anode potential of the light-emitting element EL is essentially equal to the intermediate potential Vss3 during the non-emission period. Therefore, since the anode potential of the light-emitting element EL is higher than the cathode potential thereof, the light-emitting element EL is not reversely biased during the non-emission period. Furthermore, since the anode potential of the light-emitting element EL is lower than the sum of the cathode potential Vcath and the threshold voltage Vthe1 of the light-emitting element EL, the light-emitting element EL is not turned on, but is cut off and de-energized. The low potential Vss2 is generally set to a level which is slightly lower than the level that is represented by the difference between the cathode potential Vcath and the threshold voltage Vth of the driving transistor Trd. According to the normal pixel configuration, the reference potential Vss1 of the video signal and the cathode potential Vcath are set to substantially equal levels. For performing the threshold voltage correcting process, the low potential Vss2 has to be lower than the reference potential Vss1 by more than the threshold voltage Vth. Since the reference potential Vss1 and the cathode potential Vcath are substantially equal to each other, the low potential Vss2 has to be lower than the difference Vcath−Vth. The intermediate potential Vss3 is higher than the cathode potential Vcath as described above.

When the potential of the feeding line VL is lowered from the high potential Vcc to the intermediate potential Vss3 at timing T7, the source potential of the driving transistor Trd is lowered to the intermediate potential Vss3. At this time, the gate potential of the driving transistor Trd is also lowered due to the bootstrap action of the retentive capacitor Cs. However, the gate potential of the driving transistor Trd may be less lowered than when the potential of the feeding line VL switches to the low potential Vss2. Stated otherwise, the drop of the gate potential of the driving transistor Trd may be reduced by switching the potential of the feeding line VL to the intermediate potential Vss3, rather than the low potential Vss2, during the non-emission period. Therefore, the sampling transistor Tr1 will not possibly be turned on and will not cause a current leak. The signal potential Vsig written in the retentive capacitor Cs does not fluctuate in the non-emission period, and, as a result, images displayed on the display screen are of high quality free of shading and crosstalk.

If the potential of the feeding line VL is lowered to the low potential Vss2, rather than the intermediate potential Vss3, in the non-emission period T7-T8, then since the gate voltage Vgs of the driving transistor Trd is of the same value as in the emission period, the gate potential Vg' drops to Vg'=Vss2+Vgs. At this time, as the current terminal of the sampling transistor Tr1 which is connected to the gate G of the driving transistor Trd serves as a source, the source potential Vg' of the sampling potential Tr1 becomes lower than the gate potential thereof (the low level of the control signal) by more than the threshold voltage, turning on the sampling transistor Tr1. Therefore, during the non-emission period T7-T8, a current leak flows between the signal line SL and the retentive capacitor Cs, causing the gate voltage Vgs written in the retentive capacitor Cs to fluctuate. Consequently, images displayed on the display screen are of reduced quality suffering of shading and crosstalk. This drawback may be alleviated by further lowering the low level (gate-off level) of the control signal. However, if the low level of the control signal is further lowered, then the difference (power supply amplitude) between the high and low levels of the control signal is increased beyond the withstand voltage limit of the transistor. According to the embodiment of the present invention, since the potential of the feed line VL is lowered to the intermediate potential Vss3, rather than the low potential Vss2, during the non-emission period T7-T8, the gate potential Vg' is equal to about Vss3+Vgs. The possibility that the sampling transistor Tr1 will be turned on is low, though it depends on variations of the threshold voltage of the sampling transistor Tr1. Inasmuch a current leak does not tend to flow in the sampling transistor Tr1 during the non-emission period, the amplitude of the control signal WS is limited within the general withstand voltage range of thin-film transistors.

At timing T8, the potential of the feeding line VL rises from the intermediate potential Vss3 back to the high potential Vcc, increasing the source potential of the driving transistor Trd. The gate voltage Vgs of the driving transistor Trd also increases due to the bootstrap action. Since the anode potential of the light-emitting element EL, i.e., the source potential of the driving transistor Trd, exceeds the threshold voltage Vthe1 of the light-emitting element EL, the light-emitting element EL starts emitting light, and the pixel enters the second emission period.

At timing T9, the feeding line VL switches from the high potential Vcc to the low potential Vss2, de-energizing the light-emitting element EL. Thereafter, the pixel enters the next field in which a new signal potential Vsig is written in the retentive capacitor Cs. No problem arises if the sampling transistor Tr1 causes a current leak in the first non-emission period after timing T9. In the first non-emission period after timing T9, therefore, the potential of the feeding line VL is lowered to the low potential Vss2, but not the intermediate potential Vss3. As described above, the low potential Vss2 is of a level required in the preparatory process in preparation for correcting the threshold value also in the next field.

Figure 4:
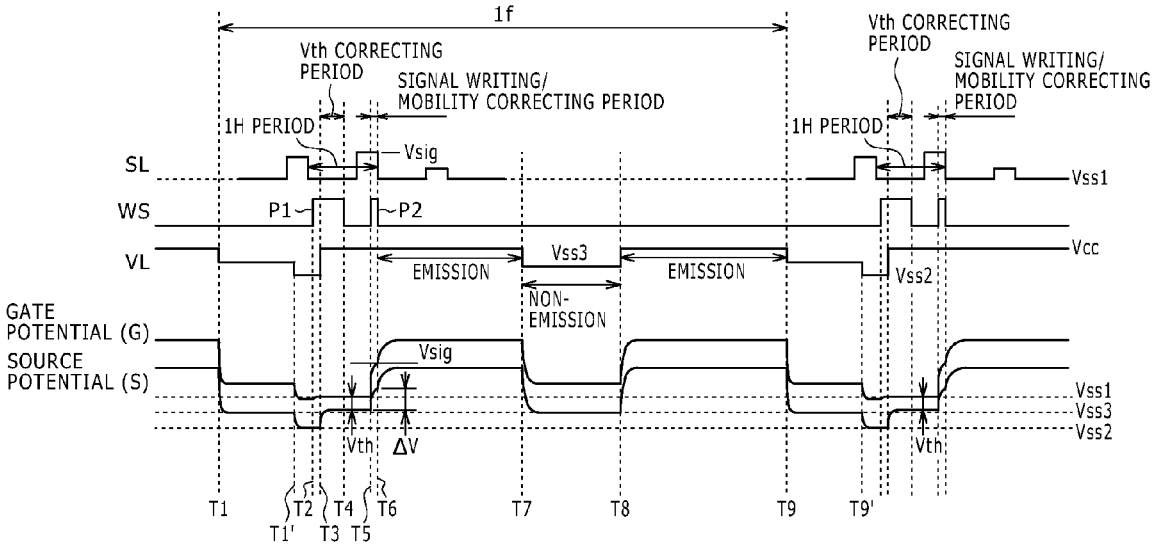
FIG. 4 is a timing chart illustrative of operation of a modification of the display apparatus according to the embodiments of the present invention.

FIG. 4 is a timing chart illustrative of operation of a modification of the display apparatus according to an embodiment of the present invention. For an easier understanding of the modification of the display apparatus, the signals and periods are indicated by the same reference characters as those used in the timing chart shown in FIG. 3. The timing chart shown in FIG. 4 is different from the timing chart shown in FIG. 3 in that in the non-emission period after the second emission period T8-T9, the potential of the feeding line VL is reduced to the intermediate potential Vss3 and thereafter to the low potential Vss2 at timing T9'. In the non-emission period T7-T8 between the first emission period and the second emission period, the potential of the feeding line VL is reduced to the intermediate potential Vss3. Since the intermediate potential Vss3 is lower than the cathode potential of the light-emitting element EL, the light-emitting element EL is not reversely biased. If the potential of the feeding line VL is reduced directly to the low potential Vss2 in the non-emission period after the second emission period as indicated by the timing chart shown in FIG. 3, then since the low potential Vss2 is lower than the cathode potential Vcath, the light-emitting element EL is reversely biased. Generally, if a reverse bias voltage is applied to the light-emitting element EL, the degradation of the characteristics of the light-emitting element EL is accelerated, and the number of defects such as pixel failures due to a light-emitting element short circuit is increased. According to the present embodiment, since no reverse bias voltage is applied to the light-emitting element EL in all the non-emission periods, the feeding line VL is kept at the intermediate potential Vss3 from timing T9 to timing T9'. However, if the feeding line VL is continuously kept at the intermediate potential Vss3 up to timing T9', then the preparatory process for the threshold voltage correcting process cannot be performed in the next field. According to the present embodiment, the potential of the feeding line VL is lowered from the intermediate potential Vss3 to the low potential Vss2 at timing 9'. In other words, the potential of the feeding line VL is lowered to the low potential Vss2 immediately prior to the threshold voltage correcting process in the next field, so that the threshold voltage correcting process can normally be performed in the next field.

Figure 5:
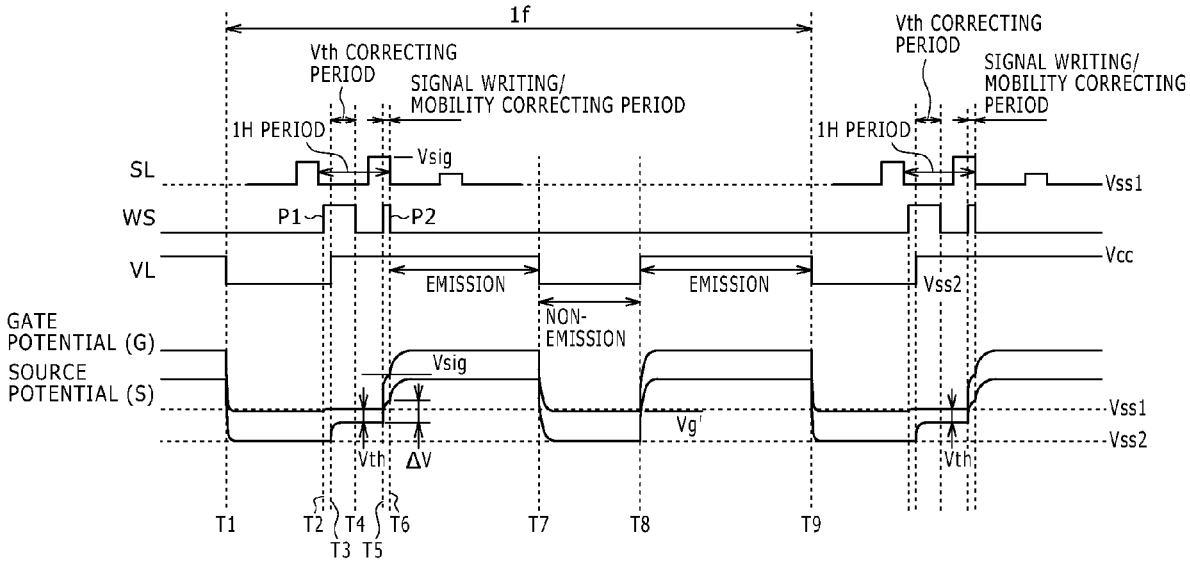
FIG. 5 is a timing chart illustrative of operation of a display apparatus according to a reference example.

FIG. 5 is a timing chart illustrative of operation of a display apparatus according to a reference example. For an easier understanding of the display apparatus according to the reference example, the signals and periods are indicated by the same reference characters as those used in the timing chart shown in FIG. 3. According to the reference example, each of the pixels 2 also alternately repeats the emission period and the non-emission period in each field in order to reduce flickering on the display screen. The display apparatus according to the reference example is different from the display apparatus according to an embodiment of the present invention in that the feeding line VL is switched to the low potential Vss2, rather than the intermediate potential Vsss3, in the non-emission period T7-T8 between the first and second emission periods. If the feeding line VL is selectively switched to two levels, rather than three levels, then the power supply scanner is made simpler in structure. However, as the low potential Vss2 which is lower than the cathode potential Vcath is applied to the anode of the light-emitting element EL in the non-emission period T7-T8, the light-emitting element EL is reversely biased and will be degraded soon. When the source potential is lowered to the low potential Vss2, the gate potential is also lowered to Vg'=Vss2+Vgs. As a result, the potential Vg' of the source of the sampling transistor Tr1 is lower than the gate-off potential of the sampling transistor Tr1, i.e., the low level of the gate control signal. Because of threshold voltage variations of the sampling transistors Tr1, the sampling transistor Tr1 may cause a current leak, possibly varying the gate voltage Vgs written in the retentive capacitor Cs.

Figure 6:
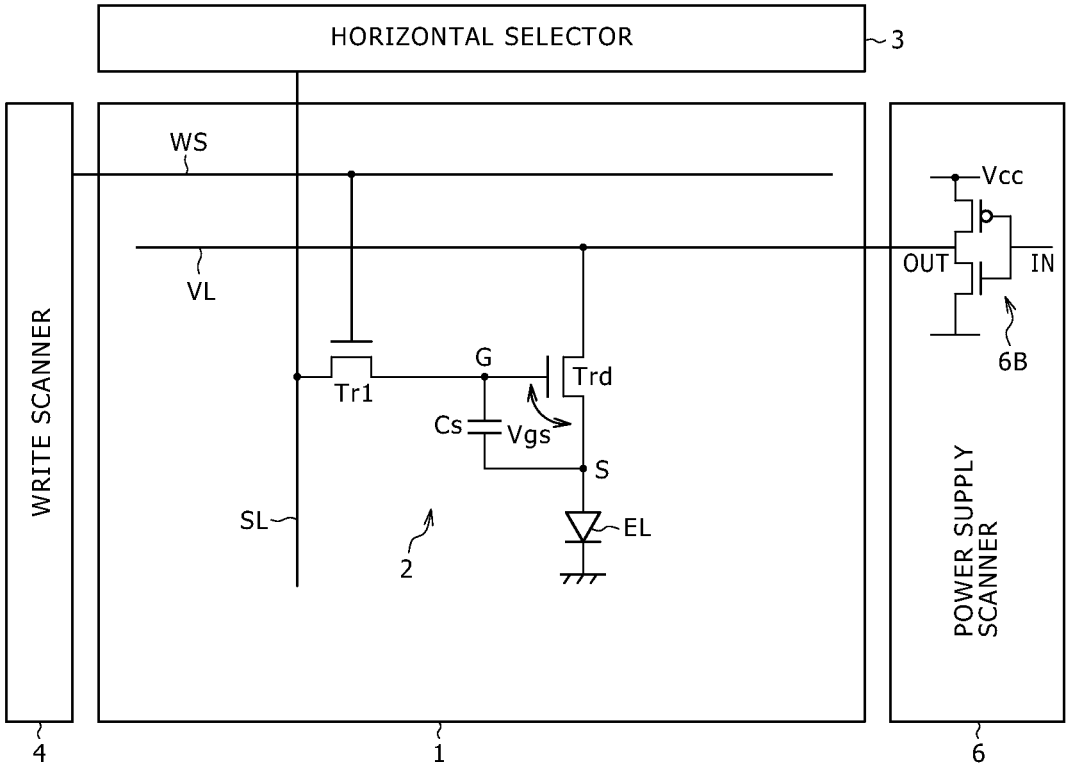
FIG. 6 is a circuit diagram of a power supply scanner included in the display apparatus according to the reference example.

FIG. 6 is a circuit diagram showing a general structure of the power supply scanner 6, which is used in the display apparatus according to the reference example. The power supply scanner 6 shown in FIG. 6 supplies the feeding line VL with a power supply voltage which switches between a high potential Vcc and a low potential. The power supply scanner 6 generally includes a shift register, not shown, and an output buffer 6B. The output buffer 6B is connected between each of the stages of the shift register and the feeding line VL. The output buffer 6B switches the power supply voltage between the high potential Vcc and the low potential and applies the power supply voltage to the feeding line VL in response to an input signal IN that is supplied from the shift register in synchronism with line-sequential scanning of the pixel array. In FIG. 6, the output buffer 6B is in the form of an inverter that includes a P-channel transistor and an N-channel transistor which are connected in series between the high potential Vcc and the low potential.

Figure 7:
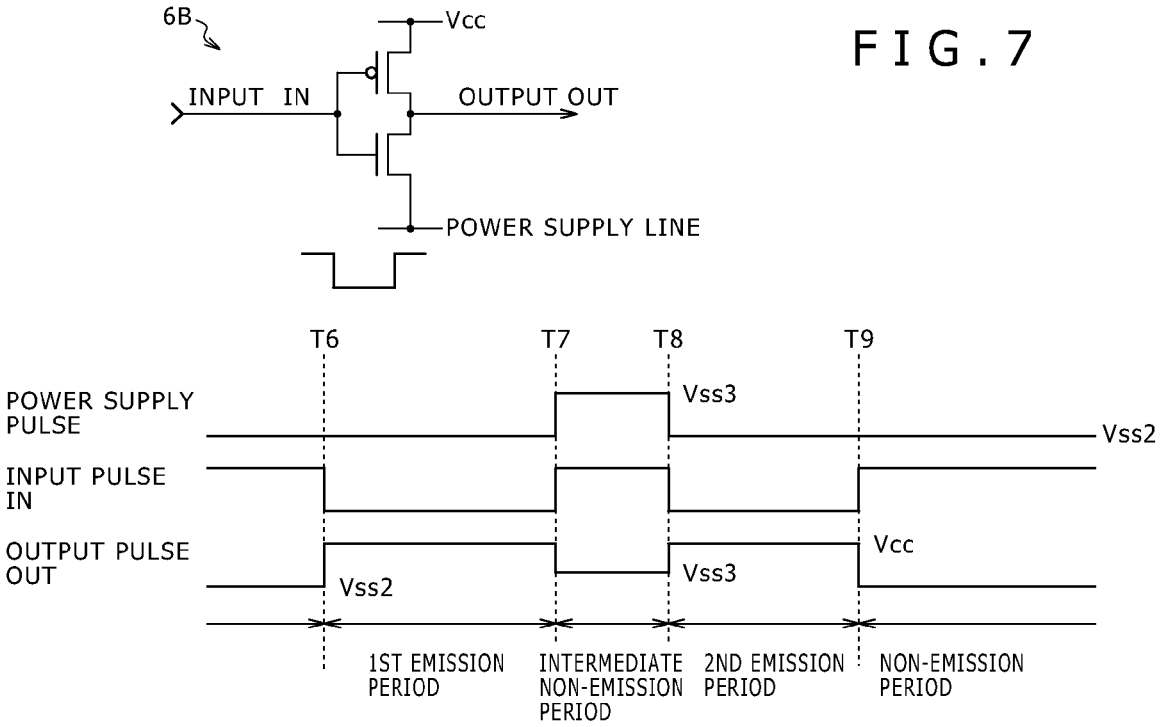
FIG. 7 is a diagram showing structural details and operation of a power supply scanner according to an embodiment which is included in the display apparatus according to the embodiments of the present invention.

FIG. 7 is a diagram showing structural details and operation of a power supply scanner according to an embodiment that is applicable to the present invention. The power supply scanner shown in FIG. 7 has an output buffer 6B designed to output three power supply levels to the feeding line. As shown in FIG. 7, the output buffer 6B is in the form of an inverter that includes a P-channel transistor and an N-channel transistor which are connected in series between the high potential Vcc and a low-potential power supply line. The inverter supplies an output signal OUT to the feeding line VL in response to an input signal IN supplied from a shift register, not shown. The low-potential power supply line is supplied with a power supply pulse from an external module.

As shown in FIG. 7, the power supply pulse has a waveform that changes in level between the low potential Vss2 and the intermediate potential Vss3. Specifically, the power supply pulse is at the low potential Vss2 in the first emission period T6-T7, rises to the intermediate potential Vss3 in the intermediate non-emission period T7-T8, and falls again to the low potential Vss2 in the second emission period T8-T9. The input pulse IN supplied from the shift register is at a low level in the first emission period T6-T7. Since the P-channel transistor of the inverter is turned on by the input pulse IN, the output pulse OUT goes to the high potential Vcc. In the intermediate non-emission period T7-T8, the input pulse IN goes to a high level. Since the N-channel transistor of the inverter is turned on by the input pulse IN, the output pulse OUT represents the potential of the power supply line. At this time, since the power supply line is at the intermediate potential Vss3, the output pulse OUT represents the intermediate potential Vss3 in the intermediate non-emission period T7-T8. Thereafter, in the second emission period T8-T9, the input pulse IN goes back to the low level again, turning on the P-channel transistor of the inverter. The output pulse OUT now represents the high potential Vcc. At timing T9 when a non-emission period of the next field begins, the input pulse IN goes to the high level, turning on the N-channel transistor of the inverter. Since the power supply line is at the low potential Vss2 at this time, the output pulse OUT is at the low potential Vss2. In this manner, the power supply scanner shown in FIG. 7 can switch the feeding line VL between the three levels Vcc, Vss3, Vss2 as indicated by the timing chart shown in FIG. 3.

FIG. 8 is a diagram showing structural details and operation of a power supply scanner according to another embodiment that is applicable to the present invention. For an easier understanding of the power supply scanner according to the other embodiment, the signals and periods are indicated by the same reference characters as those used in FIG. 7. In the embodiment shown in FIG. 7, the low-potential power supply line of the output buffer 6B is supplied with a power supply pulse from the external module. In the embodiment shown in FIG. 8, an N-channel transistor is added to switch the feeding line VL to three levels, without the need for the external power supply pulse module. As shown in FIG. 8, the output buffer 6B according to the present embodiment includes a single P-channel transistor and two N-channel transistors. One of the N-channel transistors, i.e., a first N-channel transistor, is connected between the output terminal and the low potential Vss2, and the other N-channel transistor, i.e., a second N-channel transistor, is connected between the output terminal and the intermediate potential Vss3. When the P-channel transistor and the N-channel transistors are supplied with respective input signals 1, 2, 3 from the shift register, not shown, the input buffer 6B supplies output pulses to the feeding line VL.

As shown in FIG. 8, in the first emission period T6-T7, the input signals 1, 2, 3 are at a low level, turning on only the P-channel transistor to apply the high potential Vcc to the output terminal. In the intermediate non-emission period T7-T8, the input signals 1, 3 go high in level, and the input signal 2 is at the low level. Only the second N-channel transistor is turned on, applying the intermediate potential Vss3 to the output terminal. In the second emission period T8-T9, all the input signals 1, 2, 3 are at the low level. Therefore, only the P-channel transistor is turned on, applying the high potential Vcc to the output terminal. When a next non-emission period starts at timing T9, the input signals 1, 2 go high in level and the input signal 3 goes low in level. Only the second N-channel transistor is turned on, applying the low potential Vss2 to the output terminal.

Figure 9:
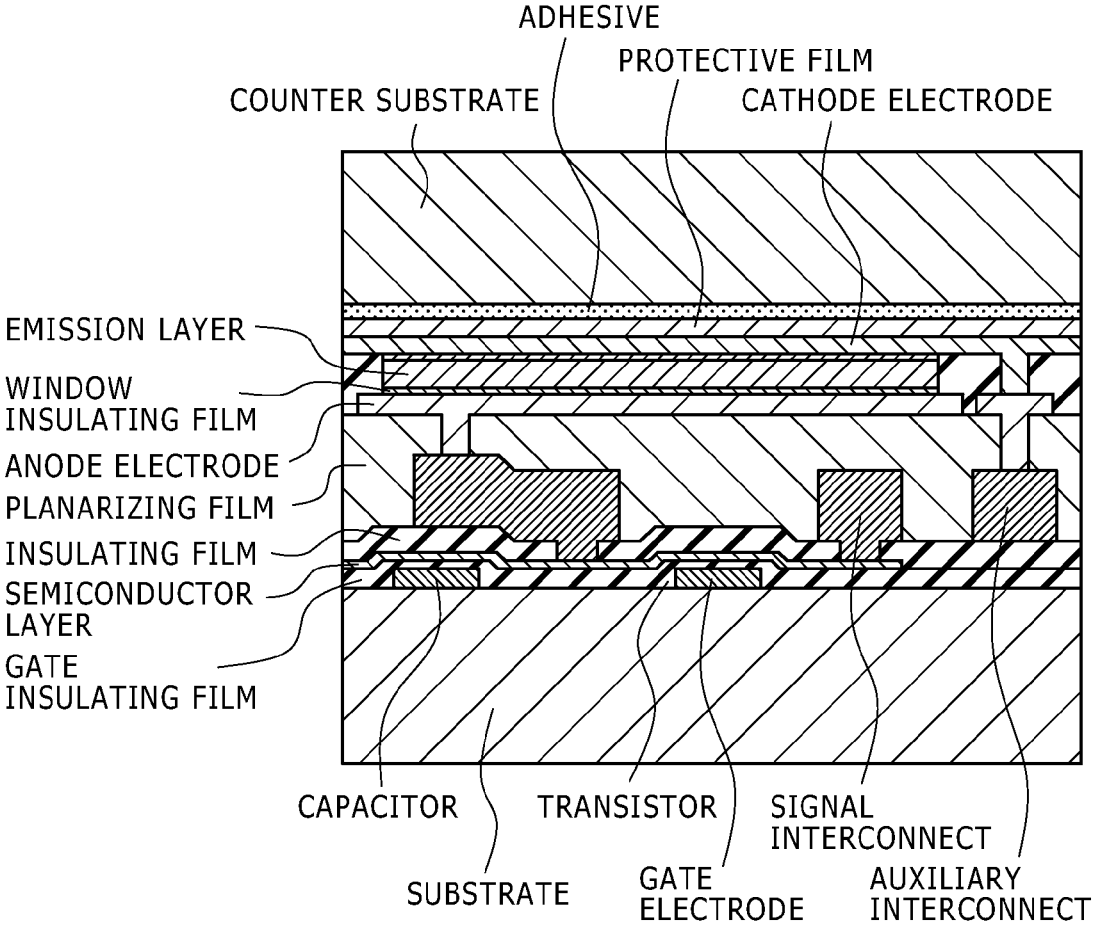
FIG. 9 is a cross-sectional view of a device configuration of the display apparatus according to the reference example.

The display apparatus according to an embodiment of the present invention has a thin-film device configuration shown in FIG. 9. FIG. 9 shows a cross-sectional structure of a pixel disposed on an insulative substrate. The pixel includes a transistor section including a plurality of thin-film transistors (one TFT is shown in FIG. 9), a capacitive section including a retentive capacitor, and a light-emitting section including an organic EL device. The transistor section and the capacitive section are formed on the substrate according to a TFT process, and the light-emitting section is deposited on the transistor section and the capacitive section. A transparent counter substrate is applied to the light-emitting section by an adhesive, thereby producing a flat display panel.

Figure 10:
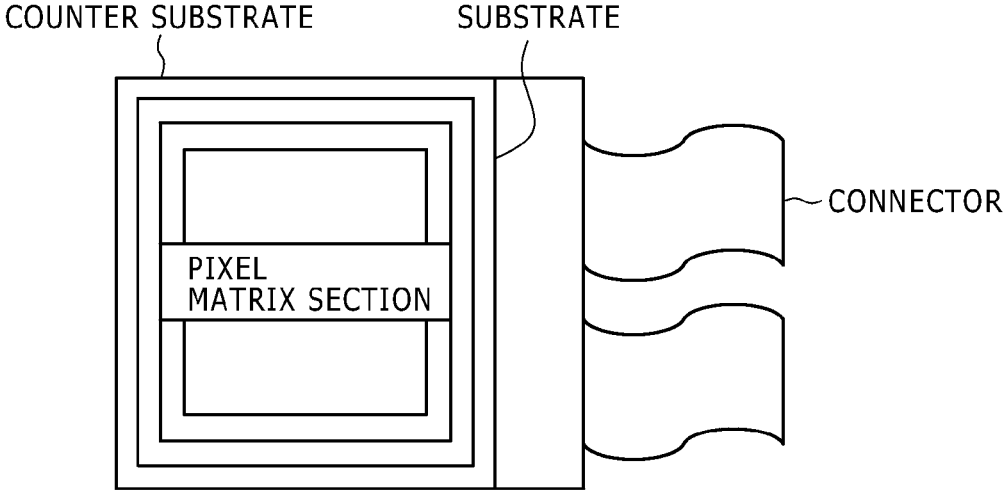
FIG. 10 is a plan view showing a module configuration of the display apparatus according to the reference example.

As shown in FIG. 10, the display apparatus according to an embodiment of the present invention may be in the form of a flat display module. To manufacture the flat display module, a pixel array section including a matrix of pixels each having an organic EL device, thin-film transistors, a thin-film capacitor, etc. is disposed on a transparent insulative substrate. An adhesive is applied to the transparent insulative substrate around the pixel array section (pixel matrix section), and a counter substrate of glass or the like is bonded, thereby producing the flat display module. If necessary, color filters, a protective film, a light shield film, etc. may be provided on the transparent insulative substrate. The flat display module may have an FPC (Flexible Printed Circuit), for example, as a connector for sending signals from an external circuit to the pixel array section and from the pixel array section to the external circuit.

The display apparatus in the form of the flat display module or panel may be used as a display panel for use on various electronic devices for displaying images based on image signals that are input to or generated by the electronic devices. Those electronic devices include a digital camera, a notebook personal computer, a cellular phone, a video camera, etc. Examples of electric devices incorporating the display apparatus according to an embodiment of the present invention will be described below.

Figure 11:
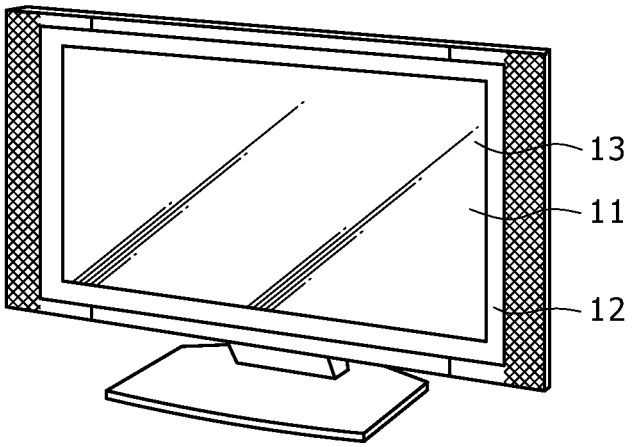
FIG. 11 is a perspective view of a television set incorporating the display apparatus according to the embodiments of the present invention.

FIG. 11 shows a television set incorporating the display apparatus according to an embodiment of the present invention. The television set including a video display screen 11 including a front panel 12, a filter glass panel 13, etc. The video display screen 11 includes the display apparatus according to an embodiment of the present invention.

Figure 12:
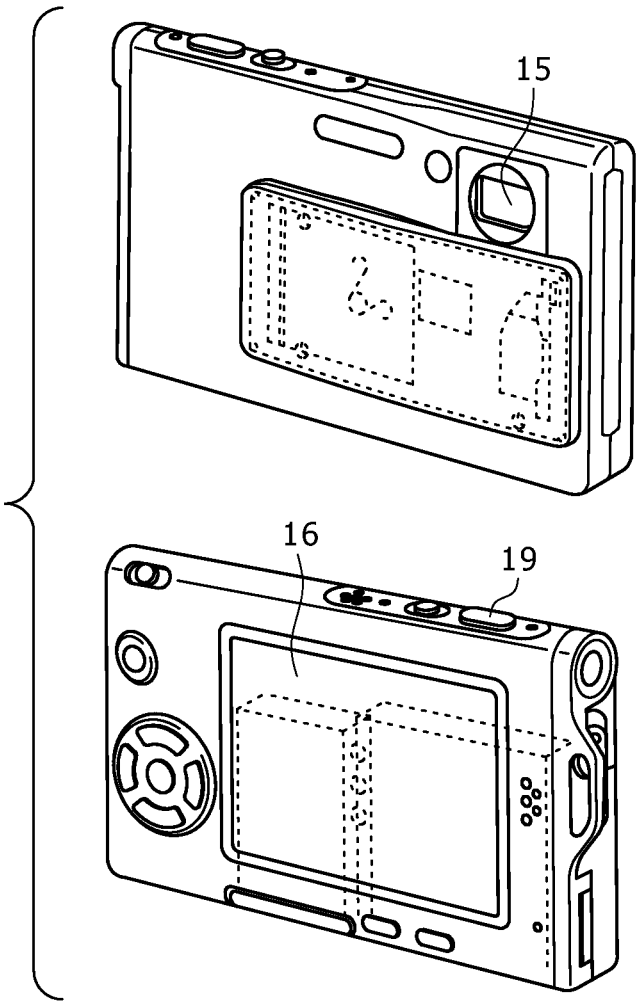
FIG. 12 is a perspective view of a digital still camera incorporating the display apparatus according to the embodiments of the present invention.

FIG. 12 shows a digital still camera incorporating the display apparatus according to an embodiment of the present invention. The digital still camera is shown in front perspective in an upper portion of FIG. 12 and in rear perspective in a lower portion of FIG. 12. The digital still camera includes an image capturing lens, a flash light emitter 15, a display unit 16, a control switch, a menu switch, a shutter 19, etc. The display unit 16 includes the display apparatus according to an embodiment of the present invention.

Figure 13:
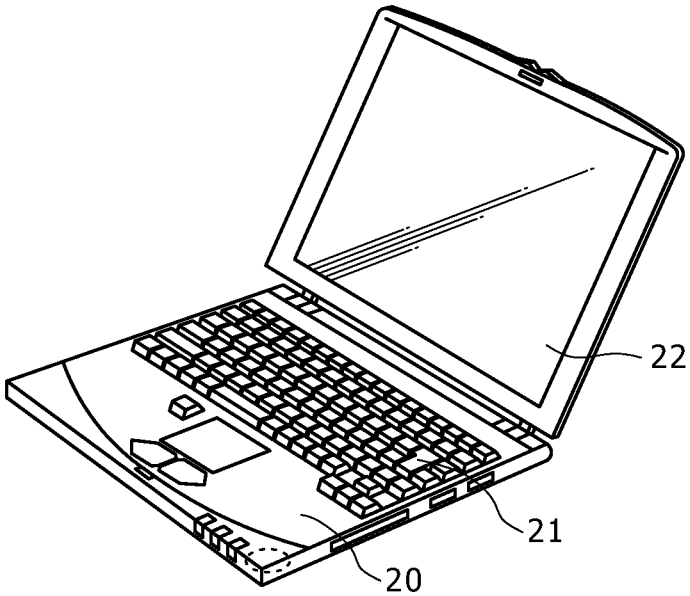
FIG. 13 is a perspective view of a notebook personal computer incorporating the display apparatus according to the embodiments of the present invention.

FIG. 13 shows a notebook personal computer incorporating the display apparatus according to an embodiment of the present invention. The notebook personal computer includes a main body 20 having a keyboard 21 that is operable for entering characters, etc. and a display unit 22 disposed in a cover for displaying images. The display unit 22 includes the display apparatus according to an embodiment of the present invention.

Figure 14:
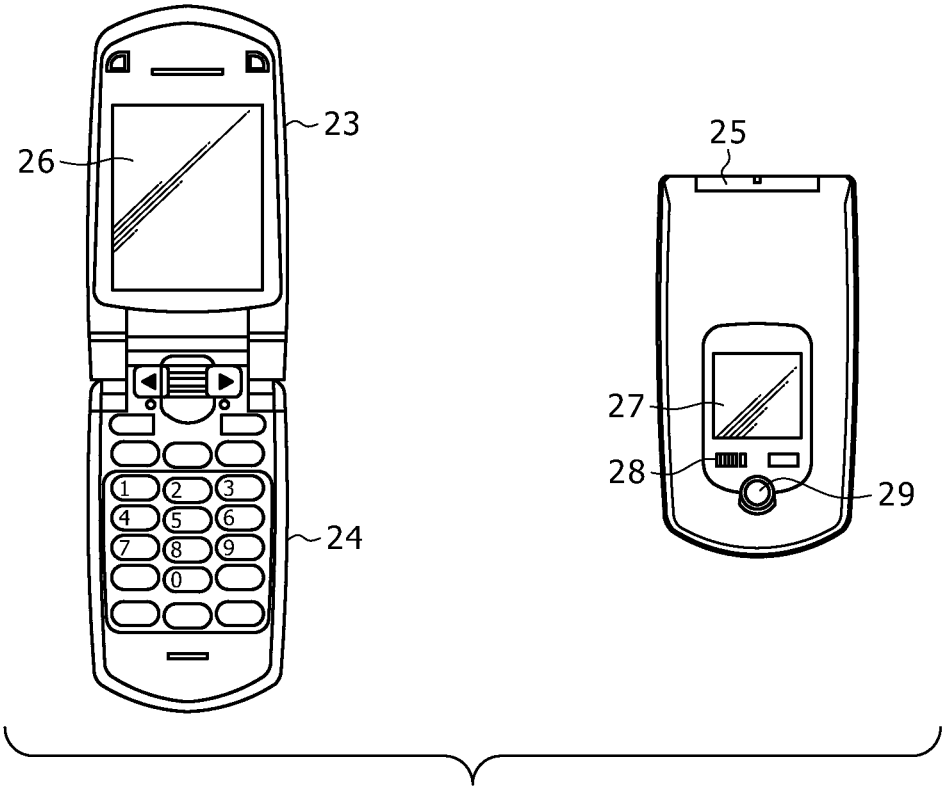
FIG. 14 is a front elevational view of a portable terminal incorporating the display apparatus according to the embodiments of the present invention.

FIG. 14 shows a portable terminal incorporating the display apparatus according to an embodiment of the present invention. The portable terminal is shown as being open in a left portion of FIG. 14 and as closed in a right portion of FIG. 14. The portable terminal includes an upper casing 23, a lower casing 24, a joint (hinge) 25 interconnecting the upper casing 23 and the lower casing 24, a display unit 26, an auxiliary display unit 27, a picture light 28, a camera 29, etc. Each of the display unit 26 and the auxiliary display unit 27 includes the display apparatus according to an embodiment of the present invention.

Figure 15:
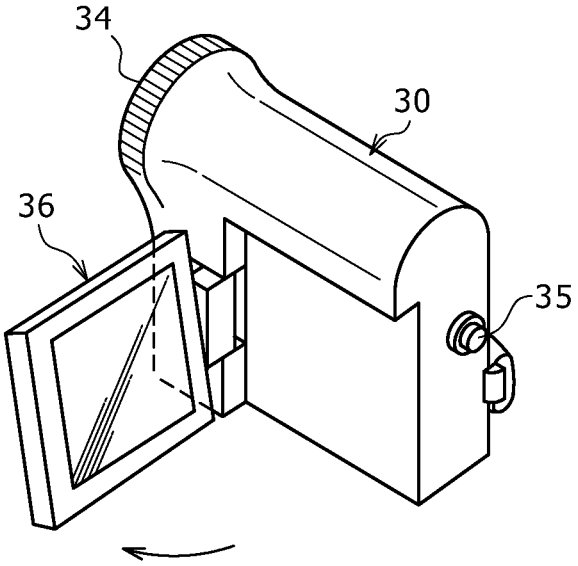
FIG. 15 is a perspective view of a video camera incorporating the display apparatus according to the embodiments of the present invention.

FIG. 15 shows a video camera incorporating the display apparatus according to an embodiment of the present invention. The video camera includes a main body 30, an image capturing lens 34 on a front side thereof, a start/stop switch 35 on a rear side thereof for capturing moving images, a monitor display unit 36 swingably mounted on the main body 30, etc. The monitor display unit 36 includes the display apparatus according to an embodiment of the present invention.

It should be understood by those skilled in the art that various modifications, combinations, sub-combinations and alterations may occur depending on design requirements and other factor in so far as they are within the scope of the appended claims or the equivalents thereof.

What is claimed is:

1. A display apparatus comprising:

a pixel array; and a driver, the pixel array including a plurality of feeding lines and a plurality of pixels, each of the plurality of pixels including a driving transistor and a light-emitting element, the driving transistor being connected between the light-emitting element and one of the plurality of feeding lines, wherein the driver is configured to, within a given field period and in order:

cause a given one of the plurality of pixels to prepare to emit light by applying a low potential in a preparation period to a given one of the plurality of feeding lines, which is connected to the given one of the plurality of pixels, cause the given one of the plurality of pixels to emit light by applying a high potential throughout a first emission period to the given one of the plurality of feeding lines, cause the given one of the plurality of pixels to stop emitting light by applying an intermediate potential throughout an intermediate non-emission period to the given one of the plurality of feeding lines, the intermediate potential being between the low and high potentials, and cause the given one of the plurality of pixels to emit light by applying the high potential throughout a second emission period to the given one of the plurality of feeding lines.

2. The display apparatus of claim 1, wherein the driver is configured to, at the beginning of the given field period, prior to the preparation period, cause the given one of the plurality of pixels to stop emitting light from a previous field period by applying the intermediate potential to the given one of the plurality of feeding lines.

3. The display apparatus of claim 2, wherein the driver is configured to, within the given field period, subsequent to applying the low potential and prior to start of the first light emitting period, cause the given one of the plurality of pixels to perform a threshold correction operation by applying the high potential to the given one of the plurality of feeding lines.

4. An electronic apparatus comprising the display apparatus of claim 1.

5. A method of driving a display apparatus comprising a pixel array including a plurality of feeding lines and a plurality of pixels, each of the plurality of pixels including a driving transistor and a light-emitting element, the driving transistor being connected between the light-emitting element and one of the plurality of feeding lines, the method comprising, within a given field period and in order:

causing a given one of the plurality of pixels to prepare to emit light by applying a low potential in a preparation period to a given one of the plurality of feeding lines, which is connected to the given one of the plurality of pixels, causing the given one of the plurality of pixels to emit light by applying a high potential throughout a first emission period to the given one of the plurality of feeding lines, causing the given one of the plurality of pixels to stop emitting light by applying an intermediate potential throughout an intermediate non-emission period to the given one of the plurality of feeding lines, the intermediate potential being between the low and high potentials, and causing the given one of the plurality of pixels to emit light by applying the high potential throughout a second emission period to the given one of the plurality of feeding lines.

* * * * *